United States Patent [19]

Schneider et al.

[11] Patent Number: 4,793,033

[45] Date of Patent: Dec. 27, 1988

[54] METHOD AND APPARATUS FOR CUTTING CARPET DESIGNS

[76] Inventors: Bruce H. Schneider; Jerry S. Schneider, both of 518 N. 10th St., Council Bluffs, Iowa 51501

[21] Appl. No.: 656,477

[22] Filed: Oct. 1, 1984

Related U.S. Application Data

[63] Continuation-in-part of Ser. No. 565,294, Dec. 27, 1983, abandoned.

[51] Int. Cl.[4] ..... D06C 23/02; B26D 1/00; B26D 3/00; B26D 5/02

[52] U.S. Cl. ..... 26/16; 83/62.1; 83/71; 83/100; 83/169; 83/925 CC

[58] Field of Search ..... 26/16, 7–10, 26/15, 15 L; 83/565, 62, 522, 925 CC, 62.1, 169, 71, 100; 30/198, 199, 210, 211, 124, 237, 216, 222, 224; 222/54; 374/141; 408/6

[56] References Cited

U.S. PATENT DOCUMENTS

| | | | |
|---|---|---|---|
| 403,682 | 5/1889 | Lowden | 26/16 |
| 652,089 | 6/1900 | Dangler . | |
| 783,753 | 2/1905 | Mougette . | |
| 845,074 | 2/1907 | Frenay . | |
| 1,183,409 | 5/1916 | Steinman . | |
| 2,088,162 | 7/1937 | Cook . | |
| 2,273,698 | 2/1942 | Ellis . | |
| 2,501,738 | 3/1950 | Prutton | 408/6 |
| 2,513,119 | 6/1950 | Stout . | |
| 2,607,101 | 8/1952 | Stout . | |
| 2,627,392 | 2/1953 | Morris | 408/6 |
| 3,360,855 | 1/1968 | Gwinn . | |
| 3,422,512 | 1/1969 | Law . | |
| 3,477,322 | 11/1969 | Gerber et al. . | |
| 3,593,615 | 7/1971 | Shelton . | |
| 3,610,081 | 10/1971 | Gerber . | |
| 3,758,924 | 9/1973 | Holm | 26/16 |
| 3,848,490 | 11/1974 | Arel . | |
| 3,864,997 | 2/1975 | Pearl et al. . | |
| 3,881,379 | 5/1975 | Stumpf . | |
| 3,895,358 | 7/1975 | Pearl . | |
| 3,939,742 | 2/1976 | Jung . | |
| 3,942,566 | 3/1976 | Schmidt . | |
| 4,085,700 | 4/1978 | Engels et al. | 26/16 |
| 4,112,560 | 9/1978 | Willbanks | 26/16 |
| 4,117,751 | 10/1978 | Inoue . | |
| 4,133,233 | 1/1979 | Pearl . | |
| 4,244,102 | 1/1981 | Bolles | 30/287 |
| 4,268,949 | 5/1980 | Sato | 408/6 |
| 4,355,557 | 10/1982 | Mecsey . | |
| 4,373,412 | 2/1983 | Gerber et al. . | |
| 4,391,170 | 7/1983 | Boverman et al. | 83/71 |
| 4,419,820 | 12/1983 | Stumpf . | |

FOREIGN PATENT DOCUMENTS

| | | |
|---|---|---|
| 2207857 | 8/1973 | Fed. Rep. of Germany . |
| 696042 | 8/1953 | United Kingdom . |
| 1365188 | 8/1974 | United Kingdom . |
| 2121214 | 12/1983 | United Kingdom . |

*Primary Examiner*—Harvey C. Hornsby
*Assistant Examiner*—Joseph S. Machuga
*Attorney, Agent, or Firm*—Welsh & Katz, Ltd.

[57] ABSTRACT

A method and apparatus is disclosed for cutting a sculptured pattern in carpet pile. The apparatus has a carpet clipping head carried by a carriage means that can move the clipping head horizontally, vertically and rotationally. Instructions from memory associated with a computer cause the carriage to move the carpet clipper along a predetermined route to cut the sculptured pattern in the carpet. The apparatus also senses the temperature of the clipping head and shuts off the apparatus if overheating occurs. A vacuum mechanism is provided to remove carpet cuttings during operation. The apparatus also dispenses lubricating fluid to the clipper head.

10 Claims, 5 Drawing Sheets

METHOD AND APPARATUS FOR CUTTING CARPET DESIGNS

This is a continuation-in-part of our prior patent application, Ser. No. 565,294, filed Dec. 27, 1983 now abandoned.

Interior designers, artisans and artists are constantly employing new design techniques to satisfy their own needs and the needs and desires of their clients. Among the techniques that have recently enjoyed more widespread use are the novel design treatments that have been employed with respect to carpeting, whether it is used on floors or walls.

Artisans have recently begun to manually sculpt a decorative design in the pile of a carpet using electric carpet shears. This design treatment is enjoying increasing popularity because the result is often not only striking, but also subtle and understated. To cut a decorative design in the carpet, it is generally necessary to use either a template that shows the pattern to be cut or to premark the carpet and thereafter manually cut the pattern in the pile. Since the sculptured effect may be a complex, intricate decorative design, it may not be capable of being carried out by someone other than a designer or accomplished artisan. If the design is complex and large scale, as may be required for a large floor carpet treatment, the sculpturing of the carpet pile may take an extensive amount of time. Not only may a particular decorative pattern require significant amount of time to actually cut, but laying out the pattern may also involve a considerable amount of time. The costs associated with such timeconsuming tasks carried out by skilled and highly paid people may effectively preclude a whole class of potential purchasers with more modest budgets from enjoying such decorative treatments.

Accordingly, it is a general object of the present invention to provide an improved method and apparatus for providing a sculptured design in the pile of a carpet generally automatically, as contrasted with a manual carving operation.

It is another object of the present invention to provide an improved method and appartus for carving a sculptured pattern in the pile of a carpet, wherein the apparatus is computer controlled and is adapted to cut any one of a number of different patterns in a carpet, which patterns are determined by instructions stored on a magnetic medium associated with the computer.

Still another object of the present invention is to provide an improved method and apparatus of the foregoing type which has a support surface for supporting the carpet to be sculptured and includes a carriage means for carrying a clipping head that cuts the pile of the carpet, wherein the apparatus vertically moves the clipping head to adjust the height thereof to accommodate undulations in the surface and thereby provide a uniform depth of cut when desired.

Yet another object of the present invention is to provide an apparatus of the foregoing type which has sensing means for measuring the temperature of a clipper head and shut off the apparatus in response to the sensing means sensing a temperature beyond a predetermined value.

Still another object of the present invention is to provide an improved apparatus of the foregoing type which includes a vacuum mechanism for removing cuttings of the carpet pile during the sculpturing of the carpet and to cool the cutting surfaces of the clipping head.

Another object of the present invention is to provide a lubricating fluid dispensing mechanism which is controlled by the computer, and which periodically provides measured amounts of lubricating fluid to the cutting surfaces of the clipping head during operation thereof and which is automatically shut off when the clipping head operation is terminated.

Other objects and advantages will become apparent from reading the ensuing detailed description, while referring to the attached drawings, in which.

DETAILED DESCRIPTION

Figures 1, 2:
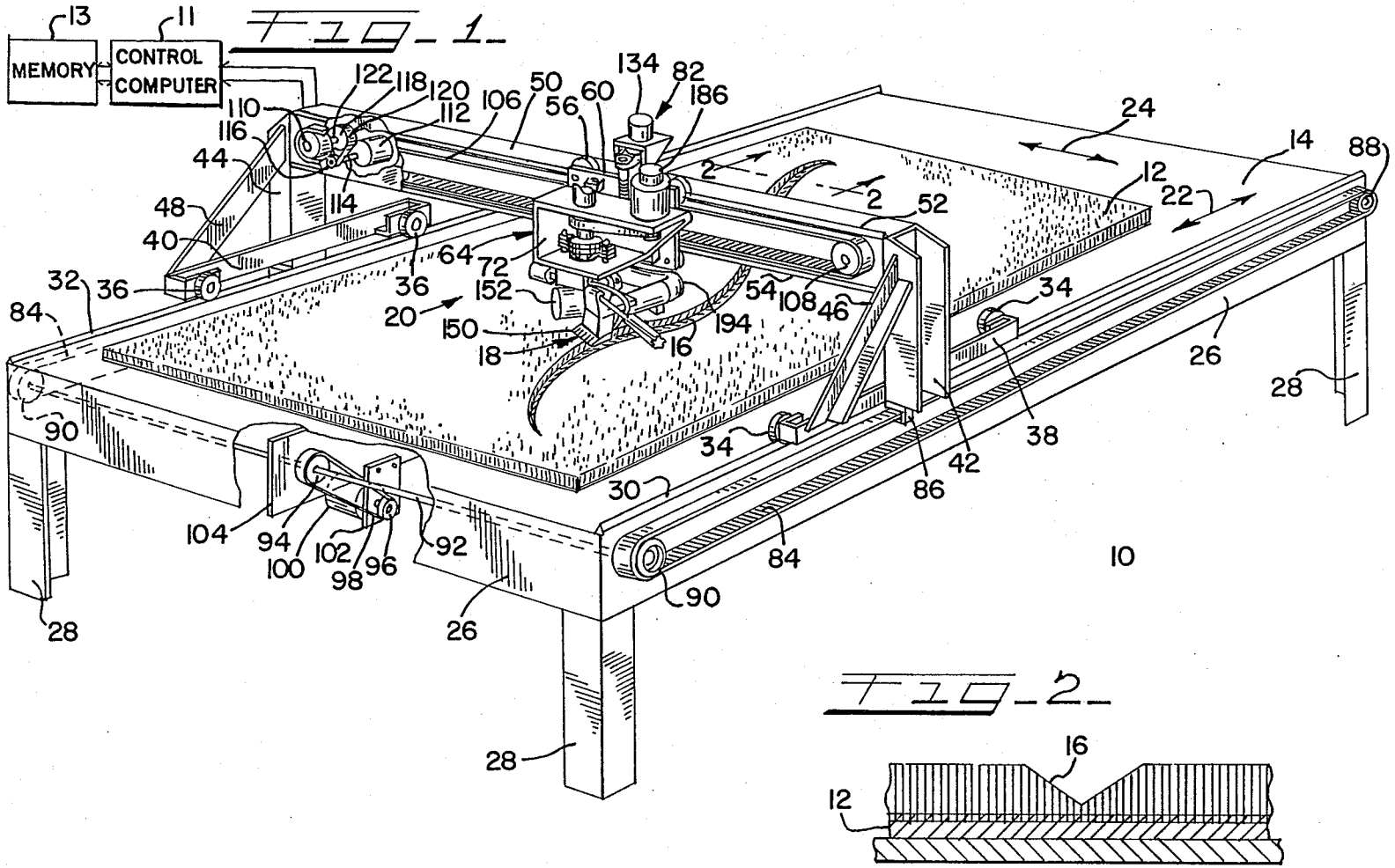
FIG. 1 is a perspective view of the apparatus of the present invention which is useful in carrying out the method of the present invention.
FIG. 2 is a cross-section of a portion of the carpet, illustrating the cross-sectional contour of a representative cut of a sculptured pattern.

Broadly stated, the present invention is directed to a method and apparatus for cutting, i.e., carving or sculpting a decorative or sculpturing pattern in the pile of a carpet. The pattern that is cut in the carpet is done by a power driven clipping head, preferably of the type which has a reciprocating blade that has cutting surfaces which interact with cutting surfaces of stationary blades and which are capable of cutting a swath of a few inches width during operation. The clipping mechanism is carried by a carriage mechanism which is adapted to move horizontally in two directions, i.e., the X and Y directions, the vertical or Z direction and rotationally. A controller computer having associated memory utilizes instructions that are stored in the memory for a design pattern, which instructions are used by the controller computer to cause the carriage to move the clipping head to cut the pattern in the pile of the carpet.

The carriage mechanism adjustably holds the clipping head so that it can be angled relative to the general plane of the carpet and when the carriage moves it through a predetermined route, it preferably cuts a V-shaped cross-sectional groove from the carpet and this is accomplished by cutting in one direction along a cutting line to cut one side of the V-shaped groove and returning along the line from the opposite direction to complete the V-shaped cut. By moving the cutting mechanism horizontally in the X and Y directions and appropriately rotating the cutting mechanism to cut curved segments and appropriately adjusting the elevation of the cutting mechanism to control the depth of cut, the decorative pattern can be completed rapidly and efficiently, essentially without operator manipulation. It is only necessary to set up the apparatus for the particular design that is to be cut into the carpet. In this regard, any number of decorative patterns or designs can be cut in the carpet, the number of patterns being virtually only a function of the size of the memory associated with the computer and this too can be virtually unlimited, if the instructions for any individual pattern are stored in separate floppy disks, magnetic tape or the like. A host computer is preferably employed and used with the controller computer to digitize a design and thereafter load the digitized design into the controller computer. The host computer can also scale the design up or down prior to loading it into the controller computer.

Particular design features of the apparatus contribute to reliable and efficient operation with a minimum of down time. Other features safeguard both the apparatus and the carpet that is to be cut in the event of malfunction of individual subsystems or components thereof. The apparatus is capable of providing relatively large scale decorative patterns and has a support surface for the carpet that may be extremely large, i.e., 9 by 12 feet or larger, if desired. It has been found, however, that since carpetlayers can combine carpet pieces so that the seams are virtually incapable of being detected without close inspection, carpeting of virtually any size can be ultimately laid with decorative patterns being cut therein at any desired location.

Turning now to the drawings, and particularly FIG. 1, there is shown a perspective view of an apparatus, indicated generally at 10, which is capable of sculpting, i.e., carving or cutting, a decorative pattern in the pile of a carpet 12 that is supported by a support surface 14. A representative curved pattern 16 is shown to be partially cut in the carpet 12 shown in FIG. 1 by a clipping or cutting mechanism, indicated generally at 18, that is supported by a carriage structure, indicated generally at 20, that is capable of movement in the longitudinal or X direction indicated by arrowed line 22, as well as movement in the Y direction indicated by arrowed line 24. Additionally, the carriage structure 20 is adapted to move the clipping mechanism 18 vertically and also rotate the cutter as necessary to cut the desired pattern. The sculptured pattern that is to be cut in the pile of the carpet 12 may be one of any number of predetermined patterns that are carried out according to instructions that are stored in the memory 13 of an associated controller computer 11. Similarly, connecting lines to the drive motors that move the carriage structure and power the cutting mechanism 18 are also not shown in FIG. 1, but are conventional and are well known in the art.

The surface 14 is adpated to support the carpet in a generally horizontal plane and is comprised of any relatively flat material that has sufficient strength to hold the carpet without vertical movement during operation of the apparatus. The surface 14 is part of a table structure having an outer perimeter frame structure 26 and for vertical legs 28 which are suitably attached to the frame structure 26. The frame members 26 and legs 28 may be fabricated from three inch angle iron, for example. The surface 14 is preferably made of any smooth, flat surface material and is preferably steel but may be plywood or the like. Support members extending across the width of the frame structure 26 may be necessary to provide sufficient rigidity to the surface 14, but as will be hereinafter described, it is not essential that it be flat within very close tolerances.

Figure 3:
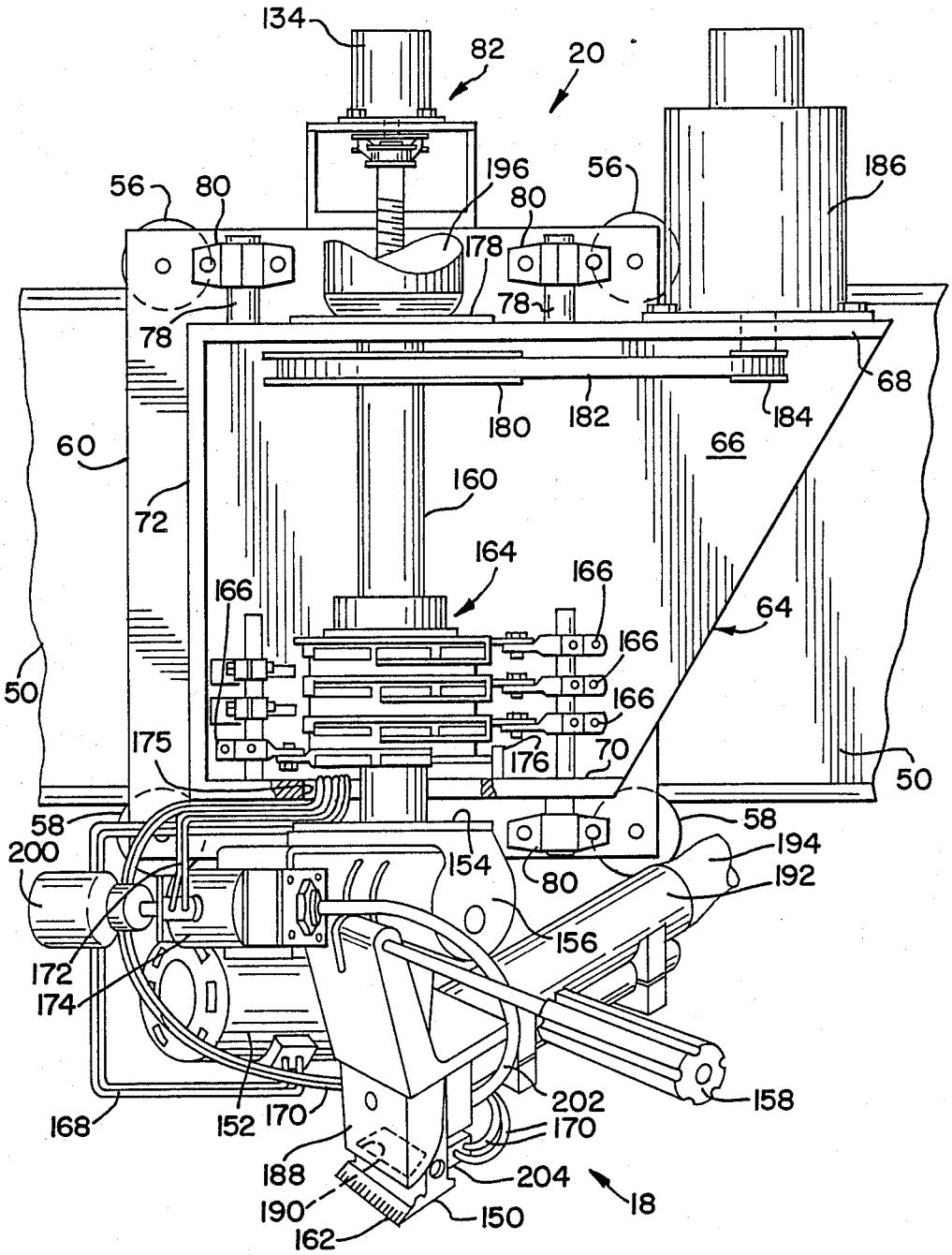
FIG. 3 is a side view of a portion of the apparatus, particularly illustrating the portion of the carriage means that carries the cutting means.
Figure 4:
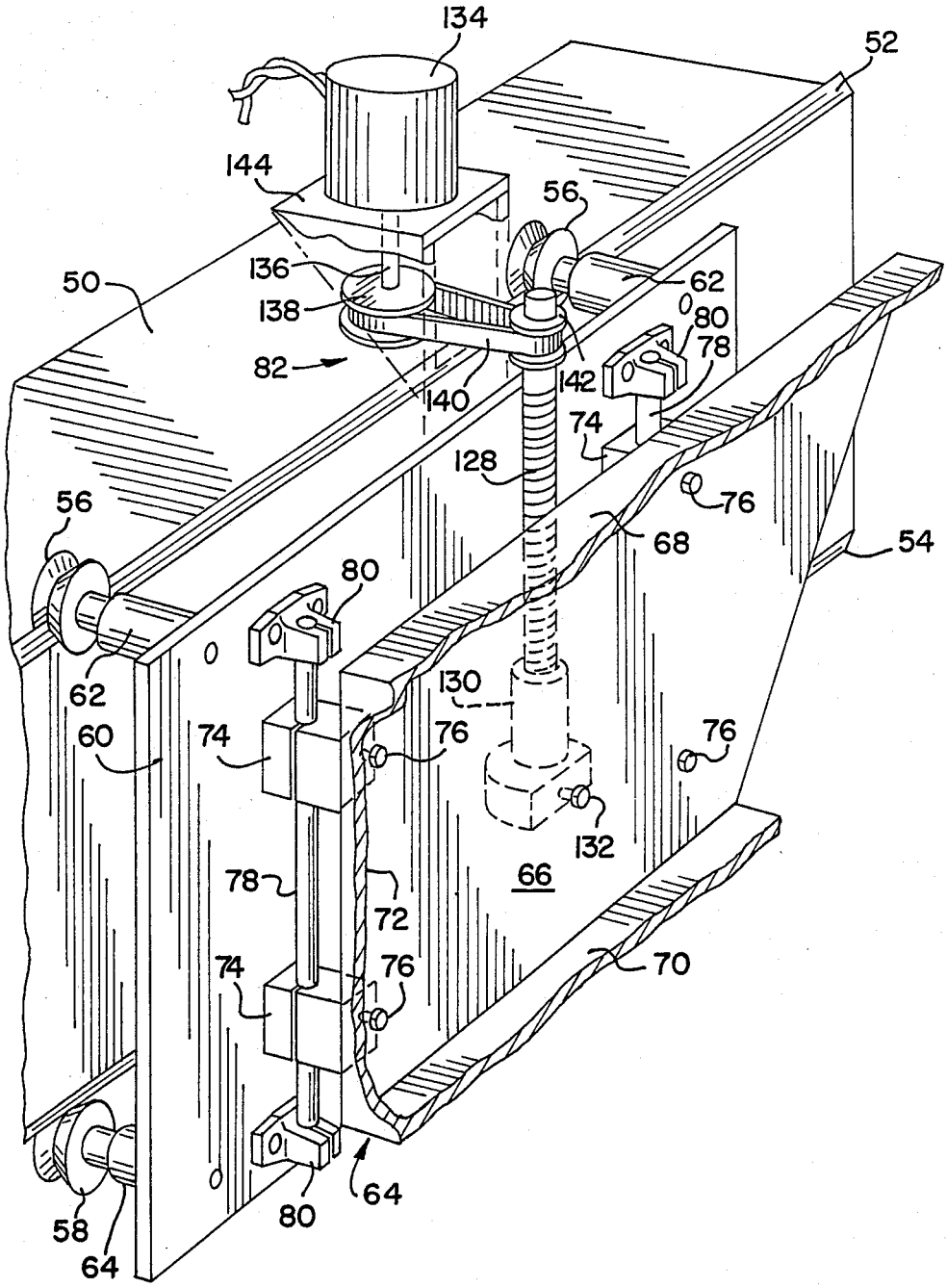
FIG. 4 is a perspective view of the apparatus shown in FIGS. 1 and 3, particularly illustrating the portion of the carriage means which controls the vertical elevation of the cutting means.

As previously mentioned, the carriage structure 20 is adapted to move the clipping mechanism 18 in three different directions, i.e., along the X, Y and Z axes, as well as rotate the same along the Z axis. To accomplish the movement in the longitudinal direction (arrowed line 22), the carriage mechanism 20 has a pair of pointed tracks 30 and 32 located on opposite sides of the support surface 14 on which the carriage mechanism 20 is movable via sets of grooved wheels or rollers 34 and 36. The rollers 34 and 36 are respectively mounted to horizontal frame members 38 and 40, which are respectively connected to vertical channels 42 and 44 by bolts, welds or the like and respective angular braces 46 and 48 are provided for additional support. A bridging channel member 50 is connected to each of the vertical channels 42 and 44 and supports the other components of the carriage mechanism and clipping mechanism. As best shown in FIGS. 4, but also shown in FIGS. 1 and 3, the bridging channel member 50 has upper and lower pointed tracks 52 and 54 which cooperate with upper and lower sets of grooved rollers 56 and 58 which are in turn attached to a vertical plate 60 by upper and lower sets of shafts 62 and 64. The plate 60 which carries the clipping mechanism 18 is thereby movable in the Y direction (arrowed line 24) along the length of the bridge channel 50 which transverses the width of the carpet 12.

Vertical movement of the cutting mechanism 18 is accomplished by means best shown in FIG. 4. An open box structure, indicated generally at 64, comprising a vertical back wall 66, a horizontal top wall 68, a bottom wall 70 and a side wall 72, is attached to slideable bushings 74 by screws 76 or the like, and the bushings 74 are slideable upon rods 78 which are mounted to the plate 60 by brackets 80. Activation of a vertical drive mechanism, indicated generally at 82, causes the box structure 64 to move vertically and the clipping mechanism 18 is mounted to the box structure 64 as will be hereinafter described.

To move the carriage mechanism 20 in the longitudinal or X direction shown by the arrowed line 22, and referring to FIG. 1, the vertical channels 42 and 44 are each attached to an endless flexible belt 84 by a conventional clamp 86 and the belt is supportably carried by pulleys 88 and 90 that are spaced from one another approximately the full length of the surface 14. The pulley 90 is attached to a rotatable drive shaft 92 that is driven by pulley 94 which in turn is connected to an output pulley 96 by endless flexible belt 98. The pulley 96 is attached to a motor/encoder 100 that is controlled by the controller computer and the encoder provides digital position signals during operation thereof to the controller computer which is indicative of the precise location of the clipping head along the length of the surface 14. The motor/encoder 100 is attached to a plate 102 which is connected to another vertically oriented plate 104 mounted to the frame 26.

To move the clipping mechanism 18 in the Y direction (arrowed line 24), a similar drive mechanism is provided in association with the bridging channel member 50. More particularly, an endless flexible drive belt 106 is carried by pulleys 108 and 110 that are located on opposite end portions of the bridging channel member 50. A clamp similar to clamp 86 attaches the plate 60 to the belt 106 and moves the plate and associated structure in the Y direction in response to operation of a motor/encoder 112 that is connected to the pulley 110 by a shaft 114, pulleys 116, 118 and endless belt 120. The pulley 118 is connected to pulley 110 by shaft 122. The controller computer operates the motor/encoder 112 in accordance with instructions that are retrieved by memory and the signals that are provided to the computer by the motor/encoder 112 provide an indication of the lateral position of the clipping mechanism 18 during operation thereof.

As is best shown in FIG. 4, the vertical position of the clipping mechanism 18 is controlled by a vertical drive mechanism 82 that moves the box structure 64 to which the clipping mechanism is mounted. This is done by a threaded shaft 128 that is mounted for rotation and is threadably engaged with a follower 130 that is secured to the box structure 64 by a screw 132 located in the rear wall 66 thereof. Rotation of the shaft 128 thereby causes the box structure 64 to be moved in a vertical direction in accordance with the direction and duration of rotation of the shaft 128. The shaft 128 is driven by a motor/encoder 134 having output shaft 136, pulley 138, flexible belt 140 and pulley 142 that is connected to the shaft 128. The motor/encoder 134 is mounted to a bracket 144 that is secured to the plate 60 by conventional means such as welding, bolts or the like. The motor/encoder 134 also supplies signals to the controller computer which defines the elevation of the clipping mechanism.

As previously mentioned, the clipping mechanism 18 is rotatable around a Z axis so that the clipping mechanism can execute curved patterns during operation. Referring to FIG. 3, the clipping mechanism has a clipping head 150 that includes a reciprocating toothed blade that cooperates with stationary teeth in a conventional manner, with the reciprocating blade being driven by an electrical motor 152 through a flexible coaxial cable (not shown) connected between the clipping head 150 and the motor 152. The clipping mechanism 18 is mounted to a plate 154 which has a tripod mount 156 that is attached to the plate 154 and has an adjustable handle 158 that can be rotated to loosen and set the attack angle of the clipping head 150 as well as the angular inclination thereof which determines the steepness of the groove that is cut in the carpet. It should be understood that while the preferred embodiment has the clipping head attack angle and the angular orientation that determines the steepness of the cut groove manually adjustable, it is within the scope of the invention to also incorporate motor encoders for adjusting these angles by the controller computer if desired.

The plate 154 is attached to a hollow shaft 160 that is rotatable so as to rotate the plate and the components that are located below the plate 154 and attached to it. The right edge identified at 162 of the clipping head 150 is positioned so that it is centered relative to the axis of the shaft 160 so that rotation of the shaft 160 rotates the entire clipping mechanism around an axis that coincides with the right edge 162 which preferably is approximately about ⅛ inch from the end of the clipping head. This provides some overlap of the clipping head when it clips along the cutting line in both directions. This insures that material is completely cut from the bottom of the groove shown in FIG. 2.

It should also be understood that while only one clipping head 150 is shown, two heads could be mounted on the box structure 64 so that the V-shaped groove could be cut while moving in a single direction. Alternatively, a single clipping head with two blades could be fabricated for cutting the V-shaped groove. It is also contemplated that a single clipping head be oriented generally horizontally to provide a notch cut if desired. It is not necessary to cut a V-shaped groove, although this shape provides an aesthetically desirable result.

Although the preferred embodiments of the present invention uses a cutting mechanism that cuts by mechanical action, other types of cutting action, e.g., a laser cutter, are within the scope of the present invention.

The shaft 160 has an electrical slip ring mechanism, indicated generally at 164, attached to it for providing electrical continuity between external power lines connected to terminals 166 which provide power to the clipper motor 152 and other electrically driven and sensing apparatus. These include lines 168 for providing power to the clipper motor 152, lines 170 for sensing the temperature of the clipping head as will be hereinafter discussed, and lines 172 which provide power to a lubricating fluid pump 174 that will also be hereinafter discussed. The lines 170, 172 and 174 are connected to the slip ring mechanism 164 and pass through an annular opening 175 in the lower plate 70 which opening is outside of the shaft 160, but inside a bushing mechanism comprised of three generally equally spaced supports 176 that contact an outer annular surface portion of the slip ring mechanism which permits rotation thereof but prohibits any horizontally directed movement. The upper end of the shaft 160 is journaled for rotation in a bushing 178. Rotation of the shaft 160 is accomplished by means of a pulley 180 connected to the shaft which carries a flexible belt 182 driven by pulley 184 that is connected to the output shaft of a motor/encoder 186 and which is connected to the controller computer. The motor/encoder 186 provides signals to the controller computer indicating the rotary position of the clipping mechanism 18.

From the foregoing description of the carriage mechanism, it should be understood that the controller computer can receive information from each of the motor/encoders 100, 112, 134 and 186 which provide digital signals indicating the precise positions of each of the four position parameters and through program control of the pattern to be cut, can provide signals to the motor/encoders to move the cutter mechanism 18 to carve or sculpt the decorative pattern that is to be cut in the carpet pile.

In accordance of another aspect of the present invention, provision is made for removing the cuttings of the carpet to keep the carpet clean during operation. In this regard and referring to FIG. 3, a vacuum system is provided for the purpose of removing the cut pile clippings and also to provide a cooling effect on the clipper head. A vacuum head assembly 188 is positioned near the clipper 162 and has an opening 190 immediately above the clipping head so that cuttings are immediately sucked into the head and exhausted in a canister at a remote location. The vacuum head 188 has an opening 190 above the clipping head 150 and communicates with a cylindrical hollow fitting 192, and it in turn is connected to the shaft 160 by a flexible tubing 194. Similarly, at the top of the shaft 160, a larger flexible tubing 196 is attached which extends to a vacuum apparatus that provides vacuum pressure to the vacuum head 188 via the aforementioned shafts, tubes and fittings.

In accordance with another aspect of the present invention and as previously mentioned, the apparatus of the present invention has provision for providing lubricating fluid to the cutting surfaces of the clipping head 150 to provide lubrication so that they will cut the carpet pile efficiently and have an extended useful life. The lubricating fluid also contributes to the temperature of the clipping head being maintained below a predetermined temperature limit which is also important to its operating efficiency. If the clipping head becomes too hot, then distortion of the cutting surfaces occurs which can result in inadequate cutting. The overheating of the clipping head is believed to produce inadequate or improper cutting due to thermal expansion which causes blade distortion or too large a spacing between cooperative cutting surfaces. Moreover, if the clipping head becomes too hot, it can burn or melt the carpet fibers which can result in a damaged carpet. The lubricating fluid is placed in a fluid tank 200 that has an outlet line in communication with the fluid pump 174 which pumps a metered amount of fluid through line 202 that is extended to a point just above the clipping head so as to provide drops of fluid on the clipping head 150. The operation of the fluid pump 174 is controlled by the controller computer and provides signals to operate the pump at periodic intervals during operation of the clipping head to lubricate the clipping head 150. When the clipping head is shut off, the computer also shuts off the pump 174.

In accordance with yet another aspect of the present invention, a head sensor 204 is provided adjacent the clipping head 150 which provides signals through the lines 170 to the computer in the event that the temperature of the clipping head 150 exceeds a predetermined limit. It has been found that a temperature limit of approximately 115° is sufficient to prohibit damage to the clipping head and insures adequate cutting of the carpet. When the temperature sensor 204 exceeds the predetermined limit, it closes a circuit which the controller computer detects and shuts off the entire apparatus. It has also been found that if the vacuum attachment becomes clogged or if lubricating fluid is not being dispensed, the clipping head will overheat which will trigger shutdown of the apparatus.

In accordance with still another aspect of the present invention, the controller computer is adapted to control the elevation of the cutting head 150 to compensate for minor variations in the elevation of the support surface 14. This is done by storing values in memory for each of a number of X, Y coordinates throughout the entire area of the surface 14. During a cutting operation, the controller computer retrieves the elevational information of the surface 14 at the particular X, Y coordinates where the clipping head is located and adjusts the elevation of the clipping head 150 through operation of the motor/encoder 134. By so doing, uniform depth of cut in the carpet is accomplished notwithstanding the fact that the surface 14 may not be perfectly flat.

While the illustrated preferred embodiment has a flat support surface 14, it is within the scope of the present invention that a convex curved surface be used. This type of surface may be desirable if a long carpet is fed from a supply roll over the surface where it is cut and then rolled onto a takeup reel. Such a sculpturing operation may be done as a final step in a manufacturing process in a carpet mill, for example, and the cutting of the design may be done while the carpet is moving over the support surface. Modification of the software could be one to compensate for the relative movement of the carpet itself in such an operation. Also, there is no absolute requirement that the carriage mechanism or the carpet support surface 14 be absolutely horizontal only that the carpet be adequately supported at positions that can be spatially identified for the controller computer so that the cutting head can be controlled relative to the carpet to ensure accurate cutting.

Figure 5A:
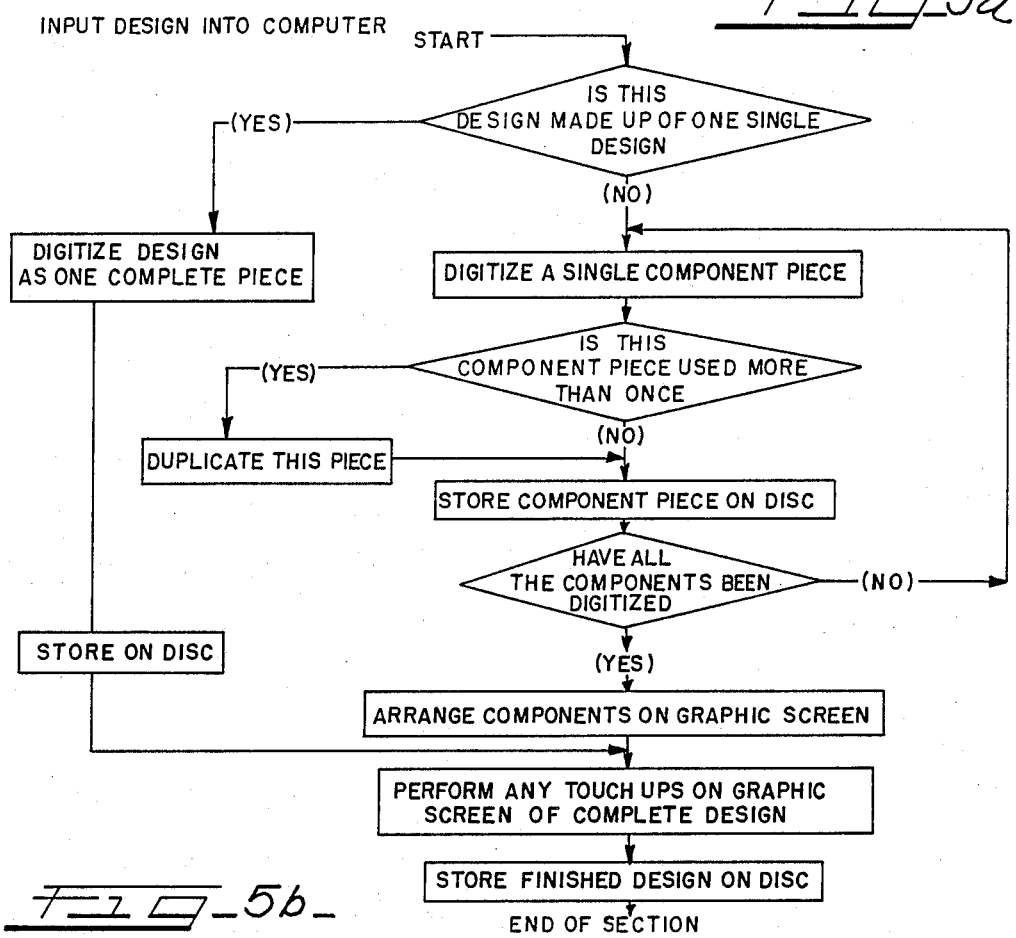
FIGS. 5*a*, 5*b* and 6 illustrate flow charts of the computer software which controls the operation of the apparatus.
Figure 5B:
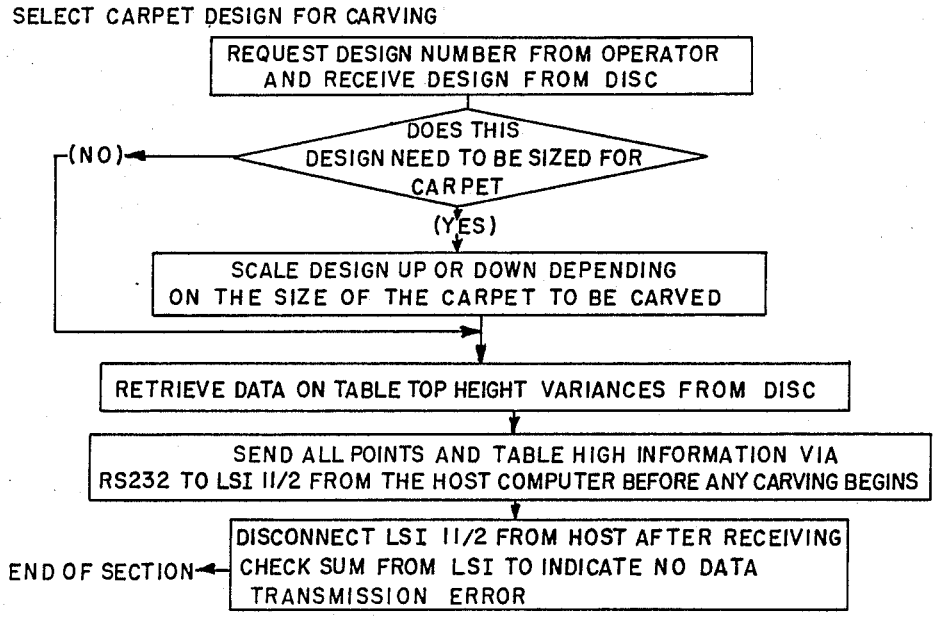

The computer control of the apparatus is preferably preformed by a host computer which may be a Digital Equipment Corporation Model PDP-11/34 with an associated disk drive and the controller computer for carrying out the specific operational instructions may be performed by a Digital Equipment Corporation computer, Model PDP-11/2. It should be understood that if a given design is to be cut from a carpet, once the instructions are loaded into the controller computer, the operation of the apparatus of the present invention can be done without assistance of the host computer. The host computer can be used in connection with a digitizing board to effectively store the necessary data and instructions for cutting any pattern that is desired. For example, a Scientific Accessory Corporation digitizing board may be used by placing a large scale drawing of a pattern on the board and using an indicating pen to physically follow the lines of the pattern and store values to enable the apparatus to cut the particular design in the carpet. The indicating pen may be used to effectively plot points and store values of the points at 1/10 or 1/16 of an inch intervals along the lines of the design. The digitizing of a particular design is accomplished by performing the steps shown in the flow chart of FIG. 5*a* which is self-explanatory. In the context of the flow chart, a component piece may represent a relatively complex design which may comprise a flower design, for example, which is to appear in each of four corners of a carpet. Only a single component or corner design need be specifically digitized and it may thereafter be shifted, turned and reproduced through operator control to complete the other corners as required. Once the complete design has been digitized and touched up as required, the complete design is thereafter stored in the disk drive.

To perform the cutting of the design, the host computer can be used to increase or decrease the scale of the design which generally depends upon such factors as the size of the carpet to be sculptured, the size of the design and orientation of the design on the carpet. Once this is determined, then the rescaled information is serially fed via a multiconductor cable between the host computer and the controller computer and the instructional data is fed into memory in the controller computer. After it has been recorded in the memory of the controller computer, then the carving or cutting of the carpet can be carried out.

Figure 6:
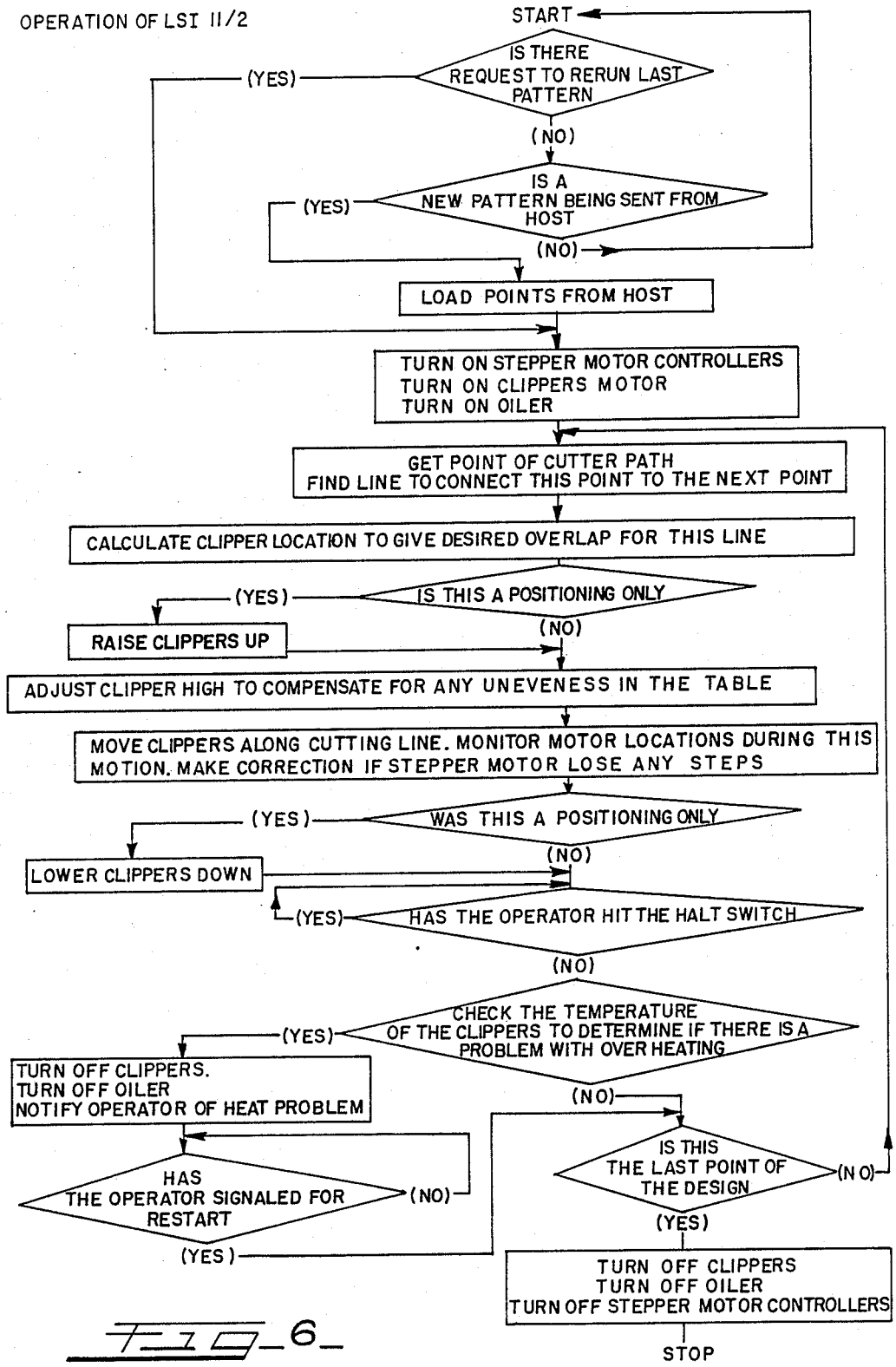

The carpet to be cut is placed on the support surface 14 with the center being located in the center of the support surface. After this is done, it is only necessary to start operation of the apparatus and the cutting of the carpet is accomplished in accordance with the steps of the flow chart shown in FIG. 6. The particular steps that are indicated will not be described in detail inasmuch as they are self-explanatory. It is noted that the steps of the program take into consideration the elevational changes in the surface, and control the operation of the motor/encoders that control the cutting head movement, as well as the operation of the clipping motor and fluid dispensing pump. Moreover, the design of a particular pattern includes instructions to raise or lower the cutting head into cutting relationship in accordance with the design to be cut. In this regard, the apparatus can raise the clipping head out of contact with the carpet as it moves to another portion of the pattern. It thereafter lowers the cutting head and continues the cutting until the design is completed. The flow chart also includes instructions which check the temperature of the clipping head and shut down the apparatus if an overheated condition occurs.

The softward listings of the object code for the controller computer is supplied herewith.

From the foregoing description, it should be understood that an improved method and apparatus for cutting a design into the pile of a carpet has been illustrated and described. The present invention has many improvements over the prior art and is extremely adaptable and efficient in terms of its capability of cutting any one of a virtually unlimited number of designs in a carpet. The invention cuts designs in the carpet quickly and efficiently and includes other features which insure its reliability and guards against damage to the carpet. The apparatus virtually opens the door to many potential purchasers who would otherwise be unable to afford such decorative embellishments because of the excessive cost of manually carving such designs in carpets.

It should be understood that although preferred embodiments of the present invention have been illustrated and described, various modifications thereof will become apparent to those skilled in the art. Accordingly, the scope of the present invention should be defined only by the appended claims and equivalents thereof.

Various features of the invention are set forth in the following claims.

What is claimed is:

1. Apparatus for cutting the pile of a carpet to provide a sculptured pattern in the carpet, comprising:

support means having a surface for supporting the carpet for cutting the pile thereof;

carriage means mounted for movement relative to said support means;

cutting means carried by said carriage means for cutting the pile of the carpet to form the sculptured pattern therein;

drive means for moving the carriage means, the operation of the drive means moving the cutting means relative to the carpet for cutting the pile to form said sculptured pattern in the carpet;

control means for controlling at least the movement of said carriage means, said control means including processing means having an associated memory means, said memory means including stored predetermined instructions defining at least one pattern of movement for the carriage means for moving at least the cutting means to cut the sculptured pattern in the carpet;

means for applying lubricating fluid to said cutting means, including a fluid reservoir and a dispensing means for dispensing the lubricating fluid to said cutting means, said dispensing means including electrical pump means, said pump means being operatively connected to said control means, said control means generating signals for activating said pump means to dispense fluid to said cutting means at predetermined intervals when said cutting means is operating, said memory means adapted to the store data and instructions for controlling the apparatus for cutting a predetermined sculptured pattern in the carpet including data identifying the elevation of each of a predetermined number of locations across said support means, said control means driving said carriage means to control the movement of said cutting means along a predetermined path relative to the carpet for cutting a predetermined sculptured pattern in the carpet and to vertically adjust the carriage means, so that said cutting means cuts the pile of the carpet at a constant depth notwithstanding any undulation of the surface of the support means.

2. Apparatus as defined in claim 1 wherein said carriage means includes means for moving said cutting means horizontally along the surface of the carpet and means for moving the cutting means generally perpendicularly relative to the surface of the carpet, said carriage means being operable to rotate said cutting means, said carriage means performing such movement in response to receiving selected control means generated signals being applied thereto.

3. Apparatus as defined in claim 1 wherein said cutting means comprises a motor driven clipping head, said clipping head being energized for operation in response to shear control signals being generated by said control means.

4. Apparatus as defined in claim 3 including sensing means for detecting the temperature of said cutting means, said sensing means generating a cutoff signal and applying the same to said control means in response to said sensed temperature exceeding a predetermined limit, said control means de-energizing said cutting means in response to said cutoff signal being generated.

5. Apparatus as defined in claim 1 further including means for removing the pile cutting of the carpet that result from the cutting of the sculptured pattern in the carpet.

6. Apparatus as defined in claim 5 wherein the removing means comprises a power driven vacuum means having a vacuum head positioned adjacent the cutting means and adapted to remove pile cuttings that result from the cutting of the sculptured pattern in the carpet.

7. Apparatus for cutting the pile of a carpet to provide a sculptured pattern in the carpet, comprising:

support means having a generally horizontal surface for supporting the carpet for cutting the pile thereof;

carriage means mounted for movement relative to said support means;

cutting means carried by said carriage means for cutting the pile of the carpet to form the sculptured pattern therein;

drive means for moving the carriage means, the operation of the drive means moving the cutting means relative to the carpet for cutting the pile to form said sculptured pattern in the carpet;

control means for controlling at least the movement of said carriage means, said control means including processing means having an associated memory means, said memory means adapted to store data and instructions for controlling the apparatus for cutting a predetermined sculptured pattern in the carpet, including data identifying the elevation of each of a predetermined number of locations across said support means, said control means driving said carriage means to control the movement of said cutting means along a predetermined path relative to the carpet for cutting a predetermined sculptured pattern in the carpet and said control means being operable to vertically adjust the carriage means so that said cutting means cuts the pile of the carpet at a constant depth nonwithstanding any undulation of the surface of the support means.

8. The apparatus of claim 7 including means for applying a lubricating fluid to said cutting means under control of said control means.

9. The apparatus of claim 7 including sensing means for detecting the temperature of said cutting means, said sensing means generating a cutoff signal and applying said cutoff signal to said control means in response to said detected temperature exceeding a predetermined limit, said control means de-energizing said cutting means in response to said cutoff signal being generated.

10. The apparatus of claim 7 further comprising means for removing pile cutting of the carpet that results from the cutting of the sculptured pattern in the carpet.

* * * * *